United States Patent [19]

Pearce

[11] 3,933,355

[45] Jan. 20, 1976

[54] SIMULATED TENNIS GAME

[76] Inventor: Donald Pearce, 111-D Village Lane, Greensboro, N.C. 27409

[22] Filed: Sept. 16, 1974

[21] Appl. No.: 506,548

[52] U.S. Cl... 273/85 R; 273/134 CA; 273/134 DB; 33/161

[51] Int. Cl.[2] ..... A63F 3/00

[58] Field of Search .... 273/85 R, 87 R, 93 R, 94 R, 273/134, 87 F, 87 G

[56] References Cited

UNITED STATES PATENTS

| | | | |
|---|---|---|---|
| 1,102,954 | 7/1914 | Ries et al. | 273/85 R |
| 1,520,081 | 12/1924 | Purnell | 273/134 DB |
| 2,618,482 | 11/1952 | Grogan | 273/134 CB |
| 3,608,901 | 9/1971 | Royle | 273/134 CG |

FOREIGN PATENTS OR APPLICATIONS

| | | | |
|---|---|---|---|
| 681,896 | 10/1952 | United Kingdom | 273/85 R |
| 1,217,728 | 12/1970 | United Kingdom | 273/134 CA |

*Primary Examiner*—Richard J. Apley
*Assistant Examiner*—Harry G. Strappello

[57] ABSTRACT

A simulated, parlor-type tennis game in which the type of shot, the direction of travel of a stroked ball, and the direction of player movement are selectively determined by a player, while the distance the stroked ball travels and the distance a player marker is moved along selected paths are determined responsive to a random selector device. A ball bounce indicator is provided to indicate on a playing board an allowable return area after the first bounce of a ball. A ball flight indicator and a player position indicator are positionable on the playing board to indicate the ball flight and player movement respectively. The outcome of a play therefore depends not only on chance, but also on the strategy invoked by the player.

4 Claims, 7 Drawing Figures

PLAY INDICATOR CHART FIGURE 5

| DICE COUNT | FIRST SERVE | SECOND SERVE | LOB | DICE COUNT | FIRST SERVE | SECOND SERVE | LOB |
|---|---|---|---|---|---|---|---|
| 666 | ACE | ACE | GOOD NO RETURN | 542 | GOOD E | GOOD E | GOOD LRP 3 |
| 665 | GOOD D | GOOD D | GOOD NO RETURN | 541 | LET | LET | GOOD LRP 2 |
| 664 | GOOD C | GOOD C | NET | 533 | FAULT | FAULT | GOOD LRP 2 |
| 663 | GOOD A | GOOD A | NET | 532 | FAULT | FAULT | GOOD LRP 6 |
| 662 | GOOD B | GOOD B | OUT | 531 | FAULT | FAULT | GOOD LRP 7 |
| 661 | GOOD A | GOOD A | NET | 522 | GOOD A | GOOD A | GOOD LRP 9 |
| 655 | GOOD E | GOOD E | OUT | 521 | GOOD E | GOOD E | GOOD NO RETURN |
| 654 | FAULT | GOOD D | OUT | 511 | FAULT | FAULT | GOOD NO RETURN |
| 653 | GOOD B | GOOD B | NET | 444 | ACE | GOOD B | NET |
| 652 | GOOD E | GOOD E | OUT | 443 | FAULT | FAULT | OUT |
| 651 | GOOD B | GOOD B | GOOD LRP 1 | 442 | GOOD B | GOOD B | GOOD LRP 3 |
| 644 | FAULT | GOOD A | NET | 441 | GOOD A | GOOD A | GOOD LRP 4 |
| 643 | FAULT | FAULT | OUT | 433 | GOOD E | GOOD E | GOOD LRP 2 |
| 642 | FAULT | GOOD E | GOOD LRP 1 | 432 | FAULT | GOOD E | GOOD LRP 5 |
| 641 | FAULT | FAULT | GOOD LRP 2 | 431 | GOOD E | GOOD E | GOOD LRP 8 |
| 633 | GOOD E | GOOD E | OUT | 422 | GOOD C | GOOD C | GOOD LRP 8 |
| 632 | GOOD B | GOOD B | GOOD LRP 6 | 421 | GOOD B | GOOD B | GOOD LRP 4 |
| 631 | GOOD E | GOOD E | GOOD LRP 7 | 411 | FAULT | GOOD B | GOOD NO RETURN |
| 622 | GOOD C | GOOD C | GOOD LRP 8 | 333 | GOOD D | GOOD D | GOOD LRP 2 |
| 621 | LET | LET | GOOD NO RETURN | 332 | LET | GOOD C | GOOD LRP 9 |
| 611 | GOOD D | GOOD D | GOOD NO RETURN | 331 | GOOD A | GOOD A | GOOD LRP 9 |
| 555 | FOOT FAULT | FOOT FAULT | NET | 322 | GOOD C | GOOD C | GOOD LRP 7 |
| 554 | FAULT | FAULT | NET | 321 | GOOD B | GOOD B | GOOD NO RETURN |
| 553 | FAULT | FAULT | OUT | 311 | GOOD A | GOOD A | GOOD NO RETURN |
| 552 | GOOD E | GOOD E | OUT | 222 | GOOD D | GOOD D | OUT |
| 551 | GOOD A | GOOD A | GOOD LRP 1 | 221 | GOOD C | GOOD C | GOOD NO RETURN |
| 544 | FAULT | GOOD E | OUT | 211 | GOOD D | GOOD D | GOOD NO RETURN |
| 543 | GOOD B | GOOD B | NET | 111 | ACE | ACE | GOOD NO RETURN |

SIMULATED TENNIS GAME

SUMMARY OF THE INVENTION

The present invention is directed to a new and unique approach to a parlor tennis game in which the actual playing conditions and strategy of the game of lawn tennis are incorporated to the extent reasonably possible. The game includes a playing board having a scale diagram of a tennis court with various landing areas indicated thereon. A random selector means, preferably in the form of three die cubes are used to determine the magnitude of travel of a stroked ball and the magnitude of player movement. As used herein the term "stroked" refers to a simulated stroke during play. It should be understood that no actual engagement of any object with a ball occurs. Although the following description refers specifically to the game of lawn tennis, it is apparent that it could easily be adapted to badminton, volleyball, handball, table tennis, and the like.

In order to incorporate as much strategy and to be as realistic as possible, a ball flight indicator is provided for selectively indicating the intended path of a stroked ball and for simulating both the acceleration as well as the magnitude of travel of a stroke. A second indicator, called a ball bounce indicator, is placed in alignment with one end of the ball flight indicator for indicating the distance between the first and second bounce of a ball responsive to one of said die cubes. A third indicator, called a player position indicator, is positioned by a player for selectively indicating the direction of player movement on the playing board, while the magnitude of player movement is determined in response to one of the die cubes.

A serve and lob chart is provided having three columns thereon for indicating the results of the first serve, the second serve, and lobs responsive to various combinations of the three die cubes.

During the course of play, a player indicates the direction he wishes to return a ball by placing the ball flight indicator along the intended path of flight. The ball flight indicator includes two scales, one slidably attached to the other. One scale indicates the distance a ball travels during acceleration, and the second, slidable scale indicates the distance the ball travels during the deceleration period before it bounces. The ball bounce indicator is placed in axial alignment with the ball flight indicator for indicating the distance between the first and second bounce of the ball. The indicia on each of the three die cubes indicate positions reached on each of the three scales, which in turn determines the final position of the ball.

In addition, the player receiving a stroke places his player position indicator along his intended path of travel, and the indicator includes a scale which determines, responsive to a cast of one die cube, how far the player travels and whether he can get to the ball return area before the second bounce.

It is therefore an object of the present invention to realistically simulate in a parlor game the actual playing conditions and strategy of the game of lawn tennis as much as possible.

It is further an object of the present invention to provide a parlor-type tennis game in which inexperienced tennis players can enhance their knowledge of the strategy of the game.

A further object is to combine strategy and chance with the emphasis on strategy as much as possible in a parlor-type tennis game.

Other objects and advantages of the present invention will become apparent upon reading the following detailed specification in association with the accompanying drawings, in which:

FIG. 5 is a chart which represents the results of the first serve, second serve, and lobs;

DETAILED DISCLOSURE OF A PREFERRED EMBODIMENT

Figure 1:
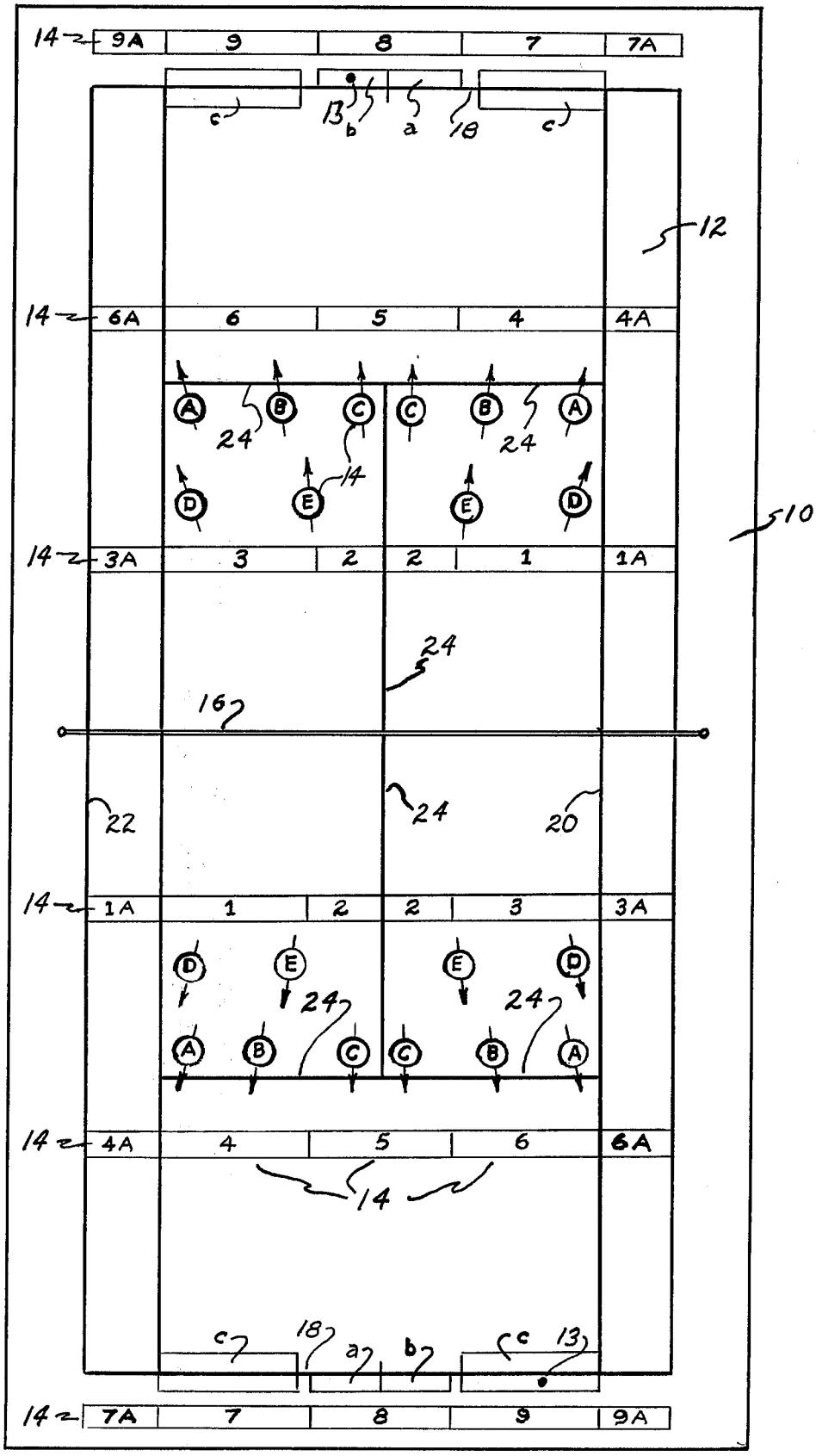
FIG. 1 is a plan view illustrating the playing board used with the present invention.

Turning now to a discussion of a preferred embodiment, the tennis game according to the present invention, in general comprises a playing board 10 having a tennis court scale diagram 12 with various landing areas 14 indicated thereon. In addition, some type of random selector means is provided. For example, three die cubes may be used, or any other type of random selection device which will provide random, three digit combinations.

In addition to the playing board 10 and random selector means, a ball flight indicator means 40 having suitable indicia on the face thereof may be selectively positioned along the intended flight path of a stroked ball. The speed and magnitude of travel of the stroke may then be set on the ball flight indicator responsive to said random selector means. A player position indicator means 60 is likewise selectively positionable along the path of player movement, and the magnitude of player movement is similarly indicated thereon during the course of play responsive to the random selector means.

Another indicator known as a ball bounce indicator 80 is, in some cases, removably positionable with respect to the ball flight indicator 40, in axial alignment therewith, for indicating the distance between the first and second bounce of the ball responsive to said random selector means. After serves, the ball bounce indicator is positioned at certain of said landing areas to indicate the distance between the first and second bounce of a serve.

Finally, a chart (FIG. 5) is provided for indicating the results of selected shots, such as serves and lobs, responsive to the random selector means.

Turning now to a more detailed description of the invention, the playing board 10, is formed of any suitable material, however is preferably formed of a material such as cork, wood, or some similar material which will readily receive a marker indicating the position of the ball and players. Preferably, such markers are pins having an enlarged colored head, one color indicating the ball, and other colors indicating the players, although other attaching means could be used. For example, the board might be coated with a metallic paint or substance with the player markers 11,13 having a piece of magnetically charged material on the bottom thereof.

The court diagram 12 is a scale diagram of a tennis court having various landing areas 14 indicated thereon. For example, the letters A, B, C, D, E, with the arrows extending therefrom indicate different landing areas within a service court to show the point within the service area where a particular serve has landed and the direction it is taking on the bounce. The areas *a*, *b*, indicate the position which the server takes to serve, while the areas *c* indicate the recommended receiving position for a player about to receive a serve.

The court diagram 12 further includes a net 16, a back boundary line 18, side boundary lines 20 for singles play, side boundary lines 22 for doubles play, and service boundary lines 24.

The areas 1, 1A, 2, 3, 3A, 4, 4A, 5, 6, 6A, 7, 7A, 8, 9, and 9A indicate lob return player position areas which will be explained hereinafter.

The ball flight indicator 40 is used to indicate the direction, speed, and magnitude of a stroke from its starting point to contact with the playing surface or the tennis net. The indicator 40 comprises two scales, one being a fixed scale 42 and the other being a slidable scale 44. A pair of parallel, longitudinally extending members 46 are suitably fixed in spaced relation to each other by a plurality of transverse plates 47 to form fixed scale 42. The moveable scale 44 is slidably retained between the two members 46 and plates 47 much in the same way as a conventional slide rule. Fixed scale 42 represents the acceleration portion of the ball flight and is graduated into numbered increments, 1–6, with the space between the numbers gradually decreasing as the numbers increase. The movable scale 44 represents the deceleration portion of the ball flight, and is graduated into numbered increments, 6–1, with the space between numbers gradually decreasing as the numbers decrease. It should be noted that the sliding scale is numbered in reverse order with respect to the fixed scale for reasons to be hereinafter described. The possible ball travel distance on the fixed scale is greater than that on the movable scale indicating that a harder hit ball will travel farther than a softly hit ball. For example, a fixed scale reading of 6 plus a movable scale reading of 2 will yield a longer total ball distance traveled than a respective reading of 5 and 3. In using the ball flight indicator, the zero point 48 of the fixed scale 42 is positioned at the point where a player strokes the ball, and the indicator 40 is physically set down along the intended path which the player selects. As the three die cubes are thrown, the largest number is set on the fixed scale 42 representing the acceleration part of the ball flight. The second highest number indicated by the three die cubes is then placed on the movable portion 44 of the ball flight indicator at a point opposite the designated point on the fixed scale. Thusly positioned, the first ball bounce will occur at the zero point 50 of the movable scale 44. The ball marker 11 is then placed at the point indicating the place on the court diagram 12 that the ball has first struck the surface of the court.

The ball bounce indicator 80 consists of a single linear member having two scales 82,84 thereon. The first scale 82 is used as a continuance of the ball flight indicator, and represents the distance that a ball travels between its first and second bounce on the playing surface. This is the area on the court that the other player must reach to be eligible to hit a return shot. Scale 82 is graduated into equally spaced numbers, 1–6 and is referred to as the ball bounce indicator or the allowable return area indicator. The second scale 84 or the volley scale is used to indicate the distance and direction traveled by a ball struck while still in flight. It is graduated into numbered positions, 1–6, with the space between the numbers being gradually increased as the numbers become higher.

Figure 3:
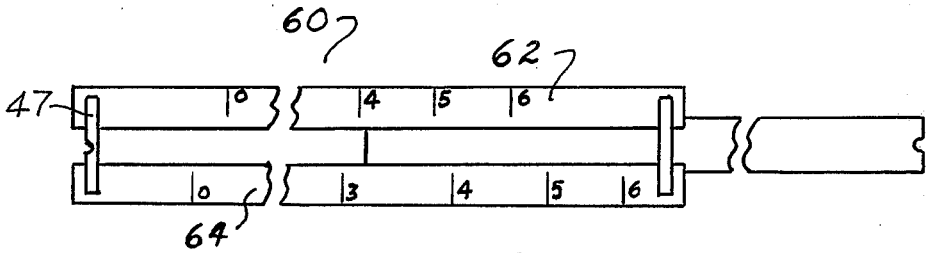
FIG. 3 is a plan view of the underside of the ball flight indicator, which is illustrative of the player position indicator.
Figure 4:
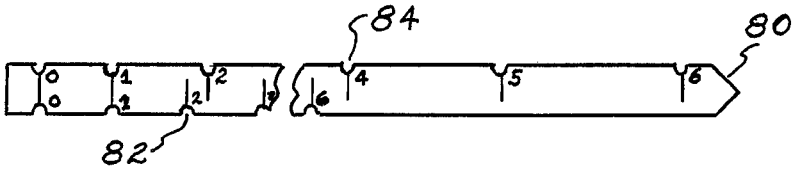
FIG. 4 is a plan view of the ball volley and bounce indicator.
Figure 7:
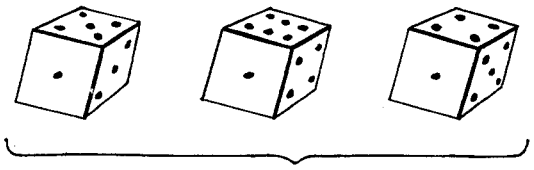
FIG. 7 is a perspective view of the random selector device, which in the preferred embodiment are three conventional die cubes.

The player position indicator 60 may be an entirely separate scale indicator, or it may be imprinted on the opposite side of the ball flight indicator 40 as shown in FIG. 3. Indicator 60 comprises two fixed scales 62,64. The first scale 62 is the player position indicator on all shots except lobs, and is used to determine the direction and magnitude of player movement during the course of play. The other fixed scale 64 determines the player position for the return of lob shots only. Each of scales 62,64 is graduated into numbered positions 1–6 with the space between the positions being gradually decreased as the numbers increase. This is for the purpose of compensating for normal movement just before and during the initial flight of a ball. The possible travel distance on the lob player position scale 64 is greater than that of the other scale 62 as a result of the longer flight time of a lob.

The scale of all of the indicators described hereinabove is compatible with the scale to which the court diagram 12 is drawn.

The play indicator chart (FIG. 5) determines the result of the serve and the lob shot during the play of the game. It consists of a listing of all possible combinations of the three die cubes. Opposite each combination, there is a space which indicates the outcome of a first serve, second serve, and lob. The column begins with the number combination 6—6—6 and decreases successively to 1—1—1. The first serve and second serve column contain a proportionate number of the possible variations of serve results encountered during actual play. The lob column will likewise contain the various possible results of a lob shot, and indicate whether a lob is good, and in which of the landing areas 14 that the lob or serve has struck the surface of the playing court.

The random selector means preferably includes three die cubes, each of the conventional type having one of the numbers 1–6 on each of the six sides and will be used by the player as set forth herein.

During play, the server will place his player marker 13 in the serve box b to the right of the court's center mark and behind the base line. The first service of each game will start from this position and then alternate right to left during the course of the game as is conventional in the rules of lawn tennis.

The server will throw the three die cubes and call out the numbers thereon in a high to low sequence, such as 6–4–1, and refer to the first serve column on the play indicator chart (FIG. 5) for the result of the serve. If the serve is an "ace" the server wins the point automatically, and moves to the alternate serving position for play of the next point. If the serve is a "fault" as indicated in the above 6–4–1 example, or a "foot-fault", the server will throw the three die cubes again, call out the number as previously indicated and refer to the second serve column on the play indicator chart for the result of this serve. If the chart indicates a good serve such as 6–6–5 which reads "good D," it means the ball has landed in the service court at position D. The ball bounce indicator is then placed at position D in the direction indicated by the arrow to represent the bounce of the ball. The opponent or "receiver" then places the player position indicator 60 so that it extends from the marker to a point intersecting the ball bounce indicator 80. If on a first serve, the intersection must be somewhere between the numbers 5 and 6 on scale 84, and if on a second serve it must be somewhere between numbers 4 and 6 on scale 82. The receiver then casts one die and moves his player FIG. 13 along the player position indicator 60 a distance equal to the number of spaces indicated by the die cube. If his number is insufficient to reach or surpass the ball bounce indicator between the points designated, the ball has passed him and he loses the point. If his number does reach or exceeds the ball bounce indicator, he places the tennis ball marker 11 and his player marker 13 at the intersection point and is now ready to hit his return stroke.

Figure 2:
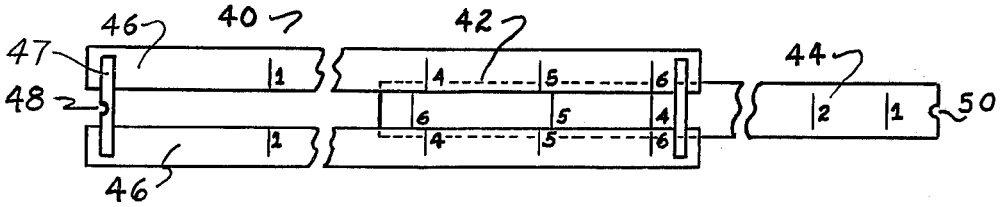
FIG. 2 is a plan view of the front side of the ball flight indicator.

The receiving player now places the starting end of the ball flight indicator 40 at the ball marker 11 and pivots the other end of the indicator in the direction he wants his return shot to follow. He then casts the three die cubes, calls out the numbers in high to low sequence, such as 6–4–2. The slidable scale 44 of the ball flight indicator 40 is moved to a position where the point 4 is opposite the point 6 on fixed scale 42, as illustrated in FIG. 2. The total of these two numbers, 6 and 4 in the example, indicate speed and length of ball flights and will immediately show whether the shot was netted, landed out of court (where the combination of the two numbers along the path indicated show a point outside of the court's diagram), or landed in the court. If the ball lands in the court, the ball bounce indicator 80 is used as described hereinabove to indicate the position the opposing player must obtain in order to be eligible to hit a return shot. In the example given herein, this would be position 2 on the ball bounce indicator 80. Play continues in this manner until the point is won or lost.

A player wishing to follow his shot to an advantageous position at the net, may announce this to his opponent and utilize the player position indicator and throw one die cube to move into his announced position before his opponent hits a return shot. If his opponent attempts a passing return shot and the highest number die carries the ball past the player at the net, it will be considered a passing shot, and the point will be awarded based on whether the ball lands in or out of court. If the highest die number does not accomplish the above, the net player may hit a volley return if he can get into the ball flight position before the first bounce occurs, or hit any type of shot return by getting into the position where the player position indicator 60 intersects the ball bounce indicator 82. Also a player wishing to improve his court position in anticipation of an opponent's shot may do so by notifying the other player of his intention prior to the other's shot. Then by using one die cube and the player position indicator, the court position change is made.

A volley, or shot struck before the ball bounces may be executed basically in the same manner as stated hereinabove, except that the volley indicator scale 84 on indicator 80 will be used, and only two die cubes will be cast, the highest number showing the flight of the ball, and the second showing the ball bounce or the allowable return area on scale 82.

A player wishing to lob must announce his intention to do so before making his shot, then casts the three die cubes and refers to the lob column on the play indicator chart (FIG. 5) for the result. There are lob return position areas marked on each side of the net playing areas and indicated in the play indicator lob column as LRP followed by the number 1–9. A player returning a lob must be able to get his player into the LRP area number designated by the lob column. There are six additional areas used in doubles play only, and these are indicated with a suffix "A", such as 1A, 2A, etc. The lob player position indicator scale 64 of the player position indicator 60 will be used instead of scale 62, to allow the player to travel a greater distance.

Figure 6:
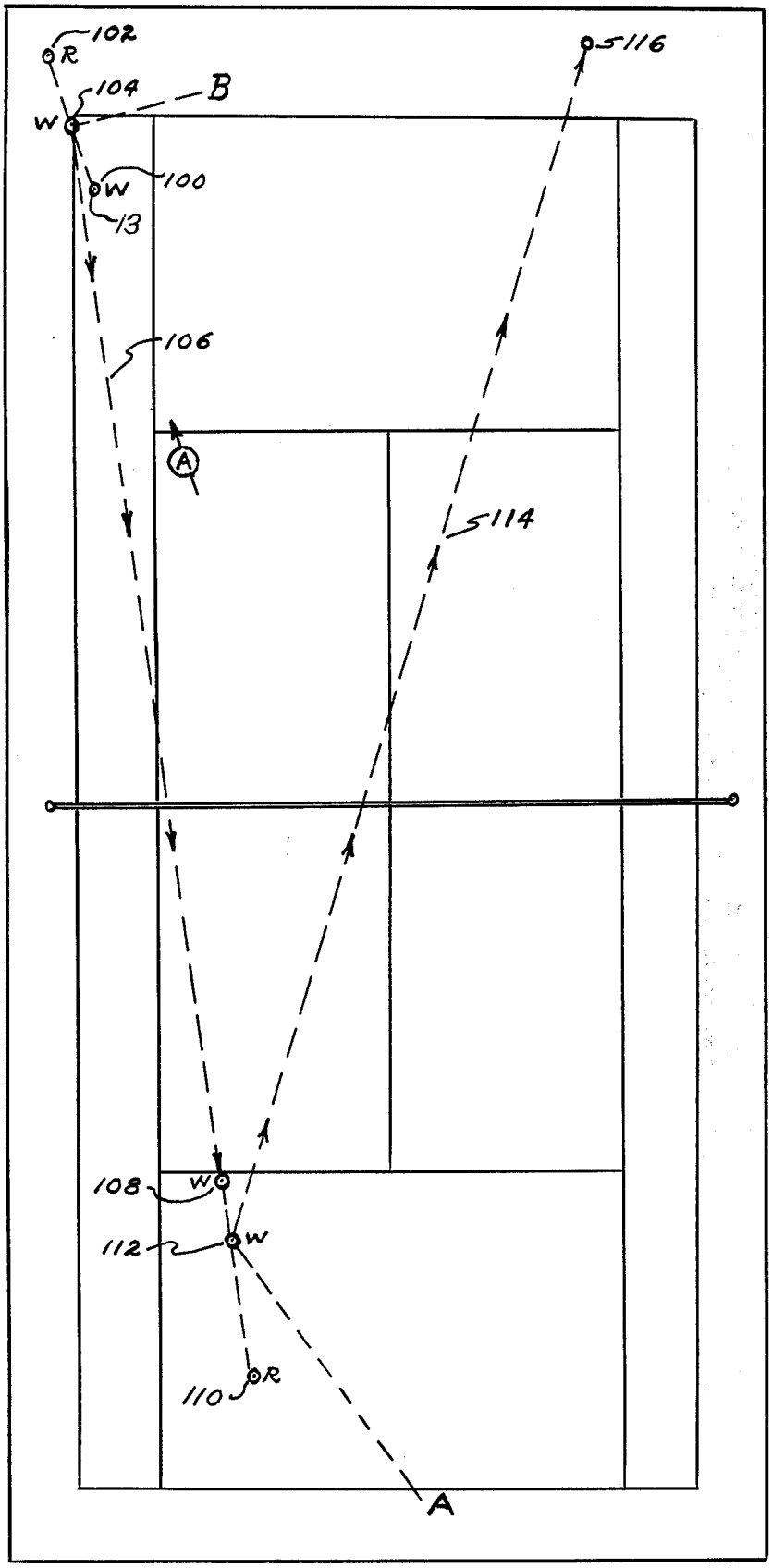
FIG. 6 is a plan view of the playing board, similar to FIG. 1, except showing a sample play executed thereon.

Referring now to FIG. 6, a better understanding of the invention will be apparent from the following discussion of the play of one point. Server A casts the three die cubes and calls out 5—5—1, and referring to the chart reads "good, position A." Since this was the first serve, the allowable return area is 5 and 6 on the ball bounce indicator 80. The server places the ball bounce indicator 80 into position in the direction indicated by the small arrow extending from A and places a first ball marker 11 at position 5 (shown as 100) and a second ball marker at position 6 (shown as 102).

Player B casts one die, which for purposes of illustration designates a 4, and places the player position indicator 60 so that it intersects the imaginary line between the two ball markers without exceeding the number 4 position. One of the ball markers is placed at this point 104. It should be noted that if player B could not reach a point between 100 and 102 with the number 4 point on the player position indicator, he would have been passed and lost the point.

Player B then places the ball flight indicator 40 with the starting position 48 at the ball marker 11 and the ball flight indicator 40 extending along his selected path down the right side line indicated by the dotted line 106. He then casts the three die cubes, which in this case show 5–4–3. The first two numbers 5 plus 4 indicate the speed and length of the shot from the start position to court contact on the ball flight indicator, and the third number 3 indicates the ball bounce or the court area the receiving player must reach to be eligible to hit a return shot. Player B moves the sliding scale 44 of the ball flight indicator 40 to line up number 4 on the center scale with number 5 on the outer scale 42, and places a first ball marker 11 at the initial ball bounce position 108 at the end of the center scale 44. He then places the ball bounce or allowable return area scale 80 in position aligned longitudinally with ball flight indicator 40 and places a second ball marker at position 3 on the scale which is designated as point 110 on diagram 12. The ball flight indicator 40 and ball bounce indicator 80 are then removed from the court.

Player A then casts one die which in this case shows 6, and placing the player position indicator 60 as described hereinabove, finds he can elect to hit his return shot from anywhere between points 108 and 110. He decides to advance forward into the allowable return area as far as possible to point 112 and strike a cross-court shot. He places the ball marker 11 at the selected spot 112, and places the ball indicator as described hereinabove, casts the die cubes and results in the number 6–5–3. The ball flight indicator 40 is adjusted as described hereinabove and discovers that he has hit the ball along the path designated 114 to point 116, which is outside the base line 18. Therefore player A loses the point.

It is obvious that, besides other playing techniques which may be incorporated into the rules of play, various modifications might be made to the invention apparatus described hereinabove without departing from the scope of the invention, which is set forth in the following claims.

What is claimed is:

1. A simulated tennis game comprising:

a. a playing board having a tennis court scale diagram with various landing areas indicated thereon, player pieces, at least one ball marker piece, and a random selector means;

b. a ball flight indicator means, selectively positionable on said playing board, for selectively indicating the intended path of a stroked ball, and for indicating the speed, magnitude of travel, and point of first bounce of a stroked ball, said random selector means determining said speed and magnitude;

c. a ball bounce indicator means positionable at said point of first bounce along the path of a stroked ball for indicating the allowable return area between the first and second bounce of a ball, said random selector means determining the distance between said first and second bounce on the board;

d. a player position indicator means, selectively positionable on the playing board, for selectively indicating the direction of player piece movement, and the magnitude of player piece movement during the course of play, said random selector means determining said magnitude of player piece movement; and e. a chart means carrying indicia indicative of results of selected shots, said random selector means cooperating with said chart means for determining a particular result.

2. The tennis game according to claim 1 wherein said ball flight indicator includes:

a. a first fixed scale for representing the acceleration phase of ball flight and b. a second longitudinal scale, means for attaching said second scale to said first scale for sliding movement thereof in a longitudinal direction, said second scale representing the deceleration phase of ball flight.

3. The tennis game according to claim 2 wherein said first and second scales are divided into numbered increments, the numbers on said first scale increasing in value and the numbers on said second, slidable scale decreasing in value, whereby two randomly selected digits are set, one on the sliding scale moved to a point aligned with the other on the fixed scale, and so arranged one end of said ball flight indicator represents the point at which a stroke is made and the other end represents the point of contact with the playing surface.

4. The tennis game according to claim 1 wherein said random selector means includes a plurality of die cubes.

* * * * *